United States Patent [19]

Dawson et al.

[11] Patent Number: 4,638,269

[45] Date of Patent: Jan. 20, 1987

[54] WIDE BAND MICROWAVE ANALOG PHASE SHIFTER

[75] Inventors: Dale E. Dawson, Glen Burnie; Anthony L. Conti, Baltimore; Soong H. Lee, Rockville, all of Md.; Gary F. Shade; Lawrence E. Dickens, both of Colorado Springs, Colo.

[73] Assignee: Westinghouse Electric Corp., Pittsburgh, Pa.

[21] Appl. No.: 738,794

[22] Filed: May 28, 1985

[51] Int. Cl.[4] ..... H01P 1/185

[52] U.S. Cl. ..... 333/164; 333/156; 333/161

[58] Field of Search ..... 333/156–157, 333/116–117, 161, 118–122, 164, 246, 248; 307/317 A, 320, 317 R; 357/15; 332/30 V, 16 R, 23 R

[56] References Cited

U.S. PATENT DOCUMENTS

| | | | |
|---|---|---|---|
| 3,516,024 | 6/1970 | Lange | 333/116 |
| 3,997,848 | 12/1976 | Rippy | 332/30 V X |
| 4,205,282 | 5/1980 | Gipprich | 333/156 |
| 4,288,763 | 9/1981 | Hopfer | 333/164 |
| 4,529,994 | 7/1985 | Sakai | 357/15 X |

OTHER PUBLICATIONS

Dawson et al.,–"An Analog X-Band Phase Shifter", IEEE 1984 Microwave and Millimeter Wave Monolithic Circuit Symposium Digest of Papers, May 29, 1984, pp. 6–10.

Swartz et al.,–"Large-Area Varactor Diode for Electrically Tunable, High Power UHF Bandpass Filter", IEEE Trans. on Electron Devices, vol. ED-27, No. 11, Nov. 1980; pp. 2146–2151.

Hughes et al.–"Mis and Schottky Barrier Microstrip Devices", Proceedings of the IEEE, Nov. 1972; pp. 1460–1461.

Gould et al.,–"Semiconductor Microwave Control Devices", Microwave Associates, Burlington, Mass., presented at Nerm 1961; pp. 1–11.

*Primary Examiner*—Marvin L. Nussbaum

*Attorney, Agent, or Firm*—W. G. Sutcliff

[57] ABSTRACT

A reflective hybrid analog phase shifter is detailed which is operable in the X-band, and which exhibits minimal phase shift variation with higher power loadings. A pair of back-to-back connected Schottky varactor diodes are serially connected to each of the phase shifting ports of a 3 dB coupler. The Scottky varactor diodes are reverse biased to permit continuous variation of the phase shift as a function of analog bias potential. A monolithically fabricated implementation of this circuit design is detailed.

3 Claims, 7 Drawing Figures

WIDE BAND MICROWAVE ANALOG PHASE SHIFTER

BACKGROUND OF THE INVENTION

The present invention relates to microwave phase shifters and more particularly to reflective, hybrid phase shifters which operate in the X-band and exhibit significantly improved power handling capability over prior art devices. Phase shifter circuits find a variety of microwave applications, but recent efforts are directed to providing wide-bandwidth phase shifter circuits with improved power handling capability for use in phased array radar systems.

PRIOR ART

Phase shifters range from the switched line length type to a variety of wave guide and microstrip circuits, which utilize varactor and pin diodes as solid state switching elements. Such prior art designs, in particular the varactor switching element designs, have exhibited serious signal level limitations. A signal of just two milliwatts causes serious phase errors in such systems in which a varactor is serially connected to the phase shifting ports of a 3 dB microwave coupler. U.S. Pat. No. 4,205,282, owned by the assignee of the present invention, teaches an electrical phase shifting circuit of the reflective type which includes a quadrature coupler branch network, with a matched pair of selectively coupled transmission lines connected to the phase shifting ports of the coupler, and with pin diode switching means connected to the coupled transmission lines.

It is desirable to fabricate an improved reflective, hybrid phase shifter on a highly miniaturized monolithic microwave chip which is operable over a wide bandwidth in the X-band frequency range and which exhibits highly accurate phase shifted output at high load levels.

SUMMARY OF THE INVENTION

A reflective, hybrid phase shifter is detailed and includes a quadrature coupler having an rf input port, an rf output port, and a first and second phase shifting port. The first and second phase shifting ports are each serially connected to a pair of back-to-back connected Schottky varactor diodes, with the cathodes of each of the varactor diodes connected to bias supply means for reverse biasing the varactor diodes. The first and second phase shifting ports are connected to the anode of one varactor diode of the pair to which the ports are respectively connected, with the anode of the other varactor diode of each pair being grounded.

A microwave hybrid coupled phase shifter circuit has been designed and fabricated on a monolithic microwave chip with a gallium arsenide insulating substrate. Four conductive pads are disposed upon the insulating substrate and comprise respectively an rf input pad, an rf output pad, and first and second phase shifting pads. A generally U-shaped closely spaced conductor pattern is disposed upon the substrate and extends between the rf input pad, the rf output pad, and the first and second phase shifting pads. The conductor pattern comprises an air bridged quadrature coupler. First and second conductors are disposed on the substrate as load inductors extending from the first and second phase shifting pads to the respective anodes of Schottky varactor diodes, with the cathodes of the Schottky varactor diodes being serially connected to the cathodes of another set of Schottky varactor diodes to form two pairs upon the substrate, and with the anodes of the other Schottky varactor diode in each pair being connected to a ground conductor being disposed upon the substrate. Bias means contact pads are disposed upon the substrate with conductors extending from the contact of the bias means contact pad to the cathodes of the Schottky varactor diode pairs. The bias means contact pad is connectable to reverse bias potential means for varying the Schottky varactor diode pairs and the phase of the output rf signal as a function of the reverse bias potential.

DESCRIPTION OF THE PREFERRED EMBODIMENTS

Figure 1:
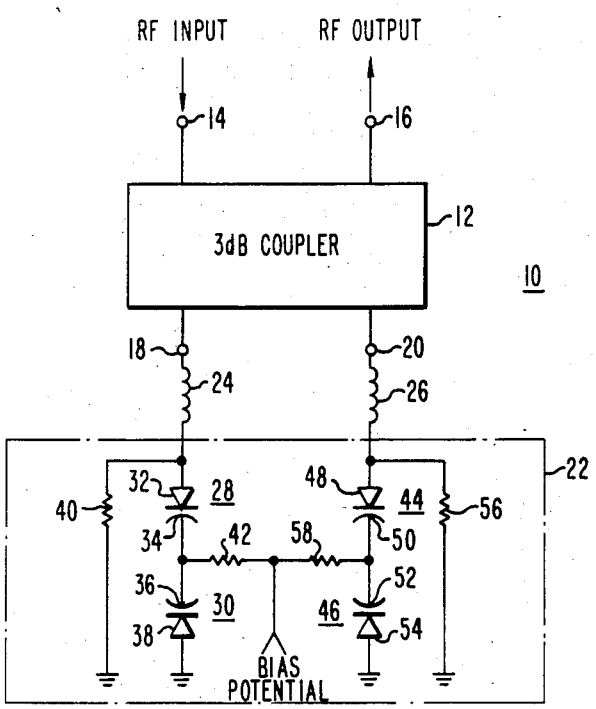
FIG. 1 is a circuit schematic illustrating the reflective hybrid phase shifter of the present invention.

The invention can be best understood by reference to the embodiments seen in the drawings and in particular in FIG. 1 the reflective hybrid phase shifter 10 comprises a 3 dB microwave coupler 12 having an rf input port 14, rf output port 16, a first phase shifting port 18 and a second phase shifting port 20. The 3 dB quadrature coupler can be any one of a variety of such couplers which provide a matched input and output for the phase shifting element 22. In series with the respective phase shifting ports 18 and 20 are tuning inductors respectively 24 and 26. The capacitive element in series with the inductor 24 serially connected to phase shifting port 18 is the pair of series connected voltage variable Schottky varactor diodes 28 and 30. The circuit elements in series connection from phase shifting ports 18 and 20 are identical and the elements in series with the first phase shifting port 18 will be described in detail first. The first phase shifting port 18 is serially connected through inductor 24 to the anode 32 of Schottky varactor diode 28 with the cathode 34 of diode 28 serially connected to the cathode 36 of Schottky varactor diode 30. The anode 38 of Schottky varactor diode 30 is connected to ground. A resistance means 40 extends in parallel with the back-to-back Schottky varactor diodes 28 and 30 from one end of the inductor 24 to ground potential. Resistor 40 is small enough in value such as 3 kilo-ohms, to provide a return path for diode leakage currents but large enough not to load the rf signal path. Resistance means 42 extends between the back-to-back cathode to cathode serial connection point to a bias potential means which provides a reverse bias for the Schottky varactor diode pair. The bias resistor has a value of about 5 kilo-ohms. The total capacitance CT across the Schottky varactor diode pair 28 and 30 is varied as a function of the reverse bias potential with this total capacitance CT comprising in series with the tuning inductor 24 the LC loading elements by which the phase of the output rf signal is varied as a function of the reverse bias potential applied to the diode pair.

This capacitance value is varied according to the equation $$C(V) = \frac{C(O)}{\left(1 - \frac{V}{\phi}\right)^n}$$

wherein C(V) is defined as the capacitance as a function of the bias potential, and C(O) is defined as the zero bias capacitance, and $\phi$ is defined as the built-in potential of the diode structure which is a function of the materials of the diode, with a typical value of 0.8 or 0.9 volts, and wherein n is a function of the activation layer doping levels for the surface oriented diodes which will be described in detail hereafter. A typical value of n is about 0.5 based on a flat dopant profile, while this value may be higher for a hyper abrupt profile structure.

In like manner the second phase shifting port 20 is connected serially to an inductor 26 and to a pair of back-to-back connected Schottky varactor diodes 44 and 46. The anode 48 of diode 44 is serially connected to the inductor 26, with the cathode 50 of diode 44 serially connected to the cathode 52 of diode 46, and with the anode 54 of diode 46 connected to ground. A resistance means 56 extends in parallel with the diode pair and is connected to ground. A resistance means 58 extends between the serially connected cathodes 50 and 52 to the reverse bias potential means. Resistors 56 and 58 are respectively equal in value to resistors 40 and 42.

The fabrication and operational characteristics of the reflective hybrid phase shifter of the present invention is described in greater detail in a paper entitled "An Analog X-band Phase Shifter" published in the IEEE 1984 Microwave and Millimeter-Wave *Monolithic Circuit Symposium,* May 29, 1984. This paper reports the testing of the phase shifter of the present invention, and demonstrates that the measured phase shift is flat over the X-band frequency range, with minimal phase shift variation at increased power loadings.

Figure 2:
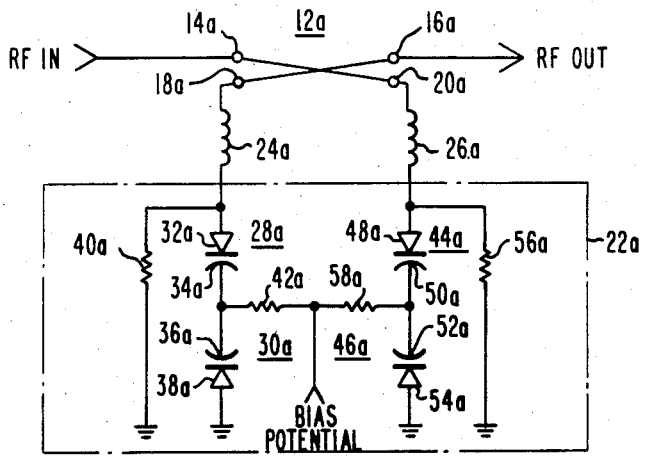
FIG. 2 is a more detailed showing of a specific reflective hybrid phase shifter of the present invention utilizing a Lange coupler.
Figure 3:
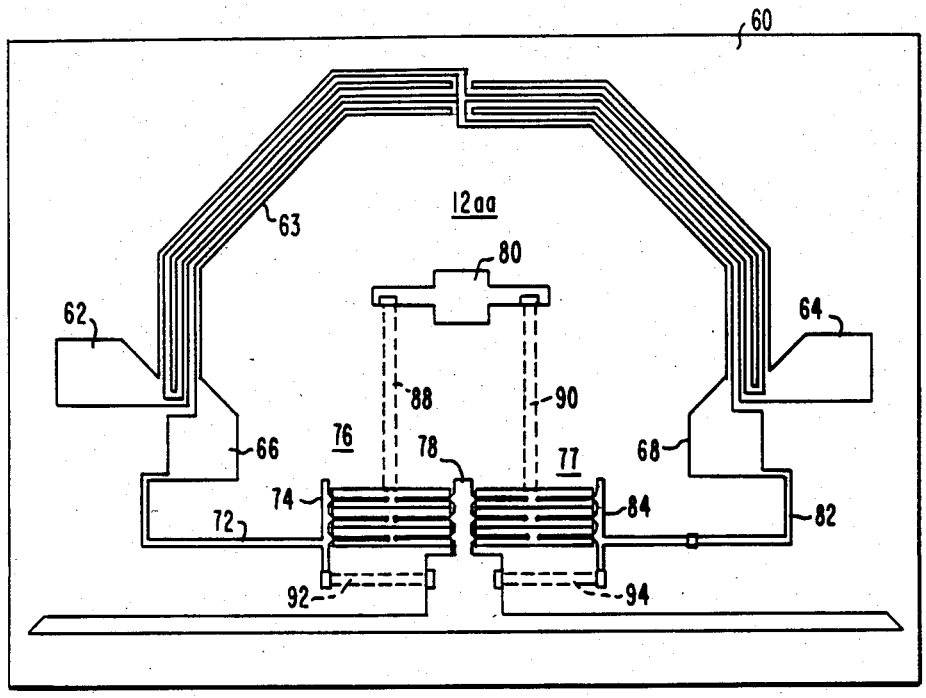
FIG. 3 is a greatly enlarged plan view of a monolithic microwave chip upon which the phase shifter of the present invention is fabricated.

The reflective hybrid coupled phase shifter described in the above referenced paper is seen in greater detail in FIGS. 2 and 3. In FIG. 2 the analog phase shifter circuit is essentially the same as that seen in FIG. 1 except that the 3 dB quadrature coupler 12 seen in FIG. 1 is more specifically a Lange 3 dB quadrature coupler seen in FIG. 2 and in FIG. 3. In FIG. 2 the Lange coupler **12*a* has rf input port 14*a* and rf output port 16*a* with a first phase shifting port 18*a* and a second phase shifting port 20*a*. The phase shifting means 22*a* seen in FIG. 2 are identical in all respects to the elements in phase shifter element 22 in FIG. 1 and all numbers are consistent with the suffix "a" being added to the numbers of FIG. 2. The phase shifter of the present invention was designed to provide a full 180° phase shift at X-band operating frequency with a capacitance variation across the diode pair of about 3:1 as the bias potential is varied over a range of 0 to 10 volts reverse bias. The phase shifter with the back-to-back Schottky varactor diodes has a very smooth well behaved variation of phase as a function of bias potential which makes the job of microprocessor control including temperature stabilization much easier. As pointed out in the above-referenced published paper, the circuit as fabricated on a monolithic microwave chip as seen in FIG. 3**, resulted in a phase shift capability of only about 105°, but this was due to the limitations of the tuning capacitance across the diode pair in the fabricated chip, and full 180° phase shift can be readily achieved.

The use of a back-to-back Schottky varactor diode design for varying the total capacitance as a function of a reverse bias potential permits the phase shifter to operate at a higher signal current without change in capacitance and phase shift. The device has superior power handling capability with an improvement of about 10:1 being exhibited over prior art designs in which a single varactor was utilized as the capacitive element in the phase shifter structure.

The monolithic microwave chip implementation of the phase shifter device of the present invention is seen in detail in FIGS. 3–7. In FIG. 3 the phase shifter is implemented on a 0.01 inch thick gallium arsenide insulating substrate 60. This insulating substrate or chip has a dimension of about 0.077×0.100 inch. In the plan view of FIG. 3 an rf input conductor pad 62, an rf output conductor pad 64 and first and second phase shifting conductor pads 66 and 68 are disposed upon the substrate. A generally U-shaped air bridged Lange coupler **12*aa* comprising closely spaced conductor patterns 63 with six air bridges extends between the rf input conductor pad 62 and the rf output conductor pad 64 and is also coupled to the first and second phase shifting conductor pads 66 and 68. This Lange quadrature coupler is folded in a U-shaped pattern to reduce overall chip size. A stripline conductor 72 extends between the first phase shifting conductor pad 66 and a contact 74 which is connected to the anode of one of the diodes of back-to-back connected Schottky varactor diode pair 76 which are ion implanted in the gallium arsenide substrate as will be described in greater detail with respect to FIGS. 4–7. A conductive ground pad 78 is disposed upon the substrate and extends from the opposed side of the back-to-back Schottky varactor diode pair 76 and is continued along the base of the chip to minimize parasitic series inductance. A bias connection pad 80 is disposed centrally on the chip between the U-shaped Lange coupler 12*aa* and the Schottky varactor diode pairs 76 and 77. In like manner the second phase shifting conductor pad 68 has serially connected to it a stripline conductor 82 which extends to conductor 84 which is serially connected to the anode of one of the diodes of back-to-back connected varactor diode pair 77. The conductor pattern stripline conductors 72 and 82 serve as the inductive tuning elements in the phase shifting circuit. Ion implanted resistor paths 88 and 90 are provided in the substrate extending between the bias connection pad 80 and passing centrally under the respective back-to-back connected Schottky varactor diode pairs 76 and 77 and more specifically under and in electrical contact with the commonly connected cathodes. This implanted resistive path permits application of the reverse bias potential to the serially connected cathodes of each of the Schottky varactor diode pairs 76 and 77. Implanted resistance paths are also provided as resistors 92 and 94 between the conductors 74 and 84 to the ground pad 78. The resistance means 92 and 94** provide parallel paths to ground to the varactor diode pairs.

Figure 4:
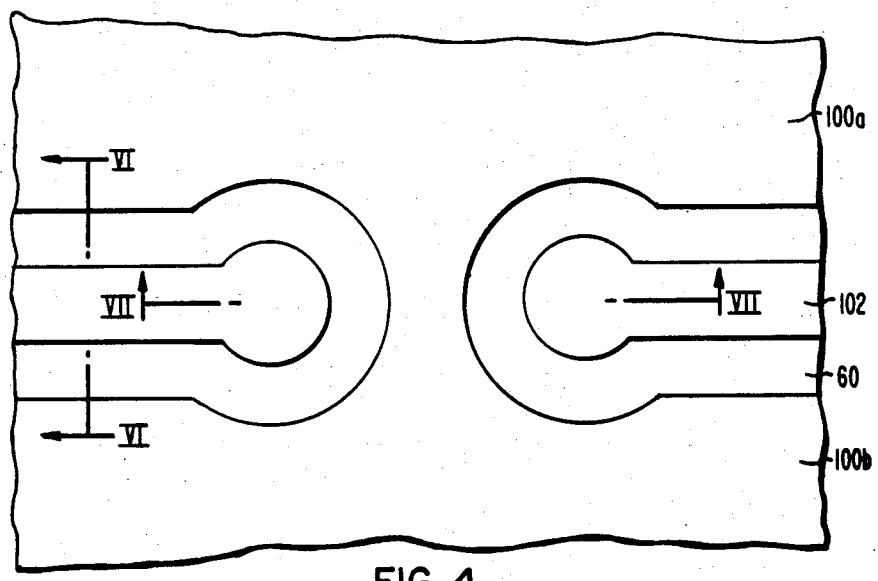
FIG. 4 is a greatly enlarged plan view of a portion of FIG. 5 illustrating the back-to-back cathode to cathode connection of a pair of Schottky diodes.
Figure 5:
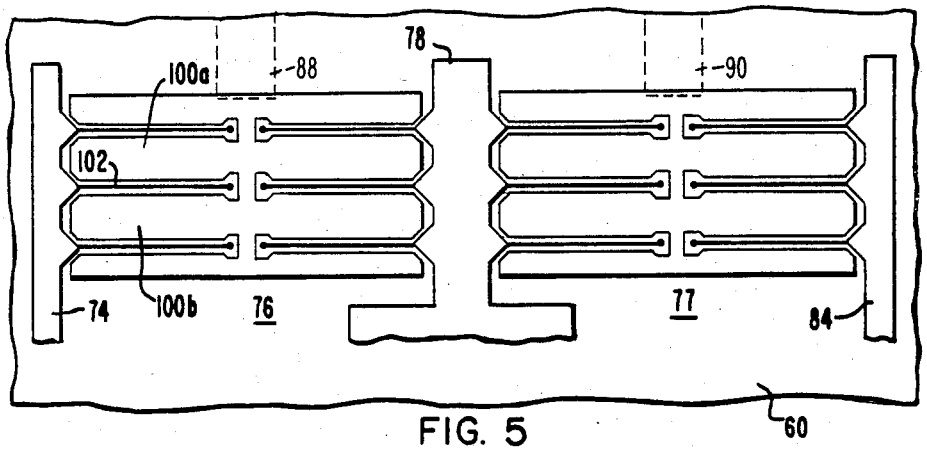
FIG. 5 is a further enlarged plan view of a portion of the microwave chip of FIG. 3 and in particular the Schottky varactor diode portion.
Figure 6:
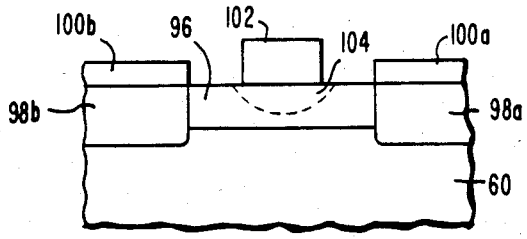
FIG. 6 is a partial sectional view taken through a portion of FIG. 4 along line VI—VI.

FIGS. 4–7 illustrate in greater detail the Schottky varactor diode pair structure utilized in the phase shifter of the present invention and like members will be used to identify like elements as in FIG. 3. In the plan view of FIG. 5 the gallium arsenide semiinsulating substrate 60 is fabricated by a liquid encapsulated Czochralski growth technique to provide the desired mobility. As seen in FIG. 6 the substrate 60 has an n doped ion implanted active layer 96 which is about 0.5 microns deep to form the active diode regions. Selectively implanted n+ regions 98*a*, 98*b* facilitate connection to the ohmic contacts 100*a*, 100*b* which are disposed upon the substrate over the n+ regions. FIG. 6 illustrates a single Schottky diode, whereas in FIG. 5 a plurality of diodes are paralleled together in forming the back-to-back connected Schottky varactor diode pairs 76, 77. Centrally disposed between the ohmic contacts 100*a*, 100*b* is the Schottky anode conductor 102 which is about 1.5 microns wide and is spaced about 1 micron from the ohmic contacts. The n type dopant which has been ion implanted provides an active layer which is as deep as possible so that breakdown of the varactor diode occurs before punch through to allow the conduction layer to completely surround the cathode side of the depletion region 104 and maintain a low series resistance. The doping concentration in the n region was chosen to be as high as possible for low series resistance, but low enough to insure 80% depletion of the active layer without breakdown in order to achieve the greatest change in capacitance. The n+ contacts were implanted deeper than the active n layer in order to provide low resistance from the ohmic contacts to the depletion region at all bias levels.

In FIG. 5, the centrally disposed ground conductor 78 separates the Schottky varactor diode pair 76 from Schottky varactor diode pair 77. FIG. 5 illustrates in an enlarged plan view the pair of back-to-back Schottky varactor diodes 76 which extend between the ground conductor 78 and stripline conductor 74, and the pair of back-to-back Schottky varactor diodes 77 extending between the ground conductor 78 and the stripline conductor 84. The ohmic metal contacts 100*a* and 100*b* cover the substrate and surround the plurality of parallel anode fingers 102 which are closely spaced from the ohmic metal contacts. The Schottky anode contacts are in fact a metal layer which electrically contacts the stripline conductors 74 and 84, as well as the ground conductor 78. These anode fingers are on the order of 100 microns long. Electrical connection to ohmics 100*a* and 100*b* is made via ion implanted resistive channels 88 and 90 in the substrate underlying the spaced apart ends of adjacent anode fingers. In this way, the reverse bias potential is applied to the diode pairs.

Figure 7:
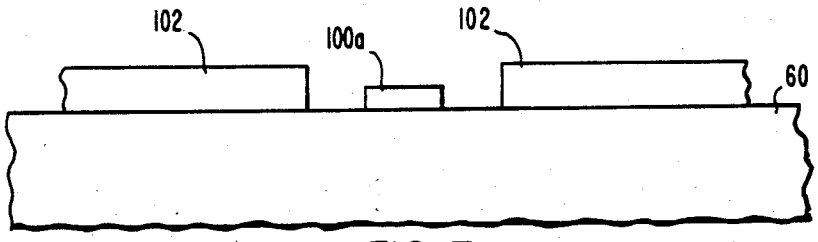
FIG. 7 is a partial sectional view taken along lines VII—VII of FIG. 4.

FIG. 7 illustrates in a partial sectional view taken along line VII—VII of FIG. 4, the spacing of conductor 102 from the ohmic contacts 100*a*, 100*b* upon the substrate 60. These ohmic contacts 100*a* and 100*b* are in fact a unitary layer of metal which serves as a common junction point which results in low shunt parasitic capacitance at this common junction. The diode pair 76 seen in FIG. 5 extends between conductor 74 and ground pad 78, with the plural parallel anodes 102 comprising the anode of the diodes of the pair. The opposed ends of anodes 102 are connected respectively to conductor 74 for one diode and to ground pad 78 for the other diode. The ohmic metal contact 100*a*, 100*b* serves as a common junction cathode to cathode connection for the diode pair.

We claim:

1. A microwave hybrid coupled phase shifter comprising:
   (a) an insulating substrate;
   (b) four conductor pads disposed upon the substrate and comprising an rf input pad, an rf output pad, and first and second phase shifting pads;
   (c) a generally U-shaped, closely spaced conductor pattern disposed on the substrate and extending between the rf input pad and the rf output pad, and the first and second phase shifting pads, which conductor pattern comprises an air bridged quadrature coupler;
   (d) first and second conductors disposed on the substrate and extending from respective first and second phase shifting pads to the anodes of Schottky varactor diodes, with the cathodes of said Schottky varactor diodes being serially connected to the cathodes of another set of Schottky varactor diodes to form two pairs upon said substrate; and with the anodes of the other Schottky varactor diodes of each pair being connected to a ground conductor disposed upon the substrate;
   (e) bias means contact pads disposed upon the substrate with conductors extending from said contact pad to the cathodes of the Schottky varactor diode pairs, which bias means contact pad is connectable to reverse bias potential means for varying the capacitance of the Schottky varactor diode pairs and the phase of the output rf signal as a function of the reverse bias potential.

2. The microwave hybrid coupled phase shifter set forth in claim 1, wherein the insulating substrate is gallium arsenide, and the Schottky varactor diodes comprise an N doped active layer selectively formed in the gallium arsenide, with the anode contacts disposed upon the active layer of the insulating substrate, and ohmic metal contacts are disposed upon the active layer of the insulating substrate spaced from the anodes as the varactor diode cathodes.

3. A reflective, hybrid phase shifter including a quadrature coupler having an rf input port, an rf output port, and a first and second phase shifting port, with said first and second phase shifting ports each serially connected to a pair of back-to-back connected Schottky varactor diodes, with the connection point of each of the varactor diodes connected to bias means for reverse biasing the varactor diodes, and with the first and second phase shifting ports connected to one opposed end of one varactor diode of the pair to which said ports are respectively connected, with the other opposed end of the other varactor diode of each pair being grounded, and wherein resistor means are disposed in parallel to each of the Schottky varactor diode pairs, which resistor means are connected to ground.

* * * * *